US005496236A

United States Patent [19]

Buonauito

[11] Patent Number: 5,496,236

[45] Date of Patent: Mar. 5, 1996

[54] PHYSICAL THERAPY APPARATUS

[76] Inventor: Robert B. Buonauito, 6335 Rambling Rd., Newport richey, Fla. 34653

[21] Appl. No.: 283,512

[22] Filed: Aug. 1, 1994

[51] Int. Cl.[6] ..... A63B 21/04

[52] U.S. Cl. ..... 482/57; 482/110; 482/62

[58] Field of Search ..... 482/57, 60, 62, 482/110, 148, 114–116, 118, 119, 121

[56] References Cited

U.S. PATENT DOCUMENTS

| | | | |
|---|---|---|---|
| 1,386,206 | 8/1921 | Samuelson | 482/62 |
| 2,675,236 | 7/1954 | Blickman | 482/62 |
| 3,226,115 | 12/1965 | Underhill | 482/62 |
| 4,373,716 | 2/1983 | Pagani | 482/62 |
| 4,538,804 | 9/1985 | Zibell | 482/62 |

*Primary Examiner*—Stephen R. Crow
*Attorney, Agent, or Firm*—Chapin, Neal & Dempsey

[57] ABSTRACT

A physical therapy apparatus capable of being used with any suitable seating surface includes a tubular frame, a seat coupling device and a means for simultaneously workout the upper and lower body. The seat interfits with the frame and has a flange portion for frictionally engaging the seating surface. The means to workout the upper and lower body is mounted on the frame and includes foot pedals and hand grips interconnected by flexible elongated members for transmitting to the hand grips the dynamic forces applied to the foot pedals and visa versa. In an alternate embodiment, the physical therapy apparatus additionally includes a fly-wheel rotatable by a crank mechanism driven by the foot pedals disposed thereon.

14 Claims, 4 Drawing Sheets

PHYSICAL THERAPY APPARATUS

FIELD OF THE INVENTION

This invention relates to a physical therapy apparatus and more particularly to such an apparatus of the type which is capable of providing for simultaneous upper and lower body aerobic workouts from a seated position that is beneficial in the physical rehabilitation of patients recovering from certain surgical procedures and the maintenance of fitness by the elderly and infirm who may be suffering from chronic, debilitating or degenerative conditions.

BACKGROUND OF THE INVENTION

Stationary exercise machines adapted for home use are abundant in the field of exercise equipment, including among others treadmills, cross-country and stair climbing machines and pedal-type machines, the most common being the stationary bicycle. Most of such presently available machines are adapted to be used by individuals who are generally healthy and ambulatory and have an interest staying in shape, reducing their weight or of improving their cardiovascular system and muscle tone. Generally, such exercise machines are not designed especially to be used by the elderly, infirm or those individuals who may be convalescing from surgery or o suffering from a chronic and/or debilitating ailment. For example, cross-country ski machines, treadmills and stair climbing machines while capable of providing the users with excellent aerobic workout of both the upper and lower body, the inherent nature of such equipment virtually precludes their use by individuals who have leg or foot problems or may be confined to wheelchairs, walkers and are not fully ambulatory. On the other hand, in using stationary bicycles and rowing machines which have specialized seats appurtenant thereto, the users must be able to achieve and maintain a sitting position on the seat provided in order to workout on such machines. In either case, however, such seats are not the type that are adapted for easy and comfortable access and use by persons suffering from a variety of physical infirmities. For example, the user must sit on the bicycle seat and operate the foot pedals that typically drive a flywheel or large fan blades which provides resistance to said movement of the pedals. Furthermore, such exercise bicycles tend to be heavy, not easily movable from place-to-place and are relatively costly. Even though such exercise bicycles do not require the user to stand, the seats are relatively small and precariously mounted on the tipper end of an upright frame or post and are not recommended for the infirm and elderly who may not have sufficient agility to clamber into the seats of such machines and while perched precariously thereon, to vigorously pedal the same. Indeed, such bicycle seat arrangements preclude or deter the use of such exercise bicycles by large numbers of persons who have balance or sitting problems, such as may be associated with vertigo, arthritis, prostate or hemorrhoid problems, or convalescing from surgery to correct such problems.

In response to the need for exercise equipment for individuals unable to use standard exercise equipment, special exercise machines are disclosed in the following U.S. Pat. Nos. which enable the user to remain seated during exercising: 2,668,790; 3,100,640; 3,259,385; 4,262,902; and 4,664,372. None of these machines, except for the one disclosed in the '372 Patent, are adapted for simultaneous aerobic exercise of the upper and lower portions of the body. The latter patent, however, is a pedal type machine primarily adapted to be used in automobiles and have a forwardly slanted front plate adapted to fit therein. That machine would have a tendency to slide about if used in the home and has a number of intricate devices which make it costly to manufacture, namely, a torsional spring operated about a hinge, a telescoping handle section and a bicycle chain sprocket. Other of the disclosed patents include means for securing the exerciser in a fixed position relative to the user's chair and involves clamping devices that are cumbersome and complex.

SUMMARY OF THE INVENTION

Accordingly, it is the primary object of the present invention to provide a physical therapy apparatus that overcomes the drawbacks of the prior art.

It is another object to provide a physical therapy apparatus which can be used in conjunction with any suitable seating surface.

It is a further object to provide a simple, inexpensive, and easy to use physical therapy apparatus which, at the same time, is capable of providing simultaneous upper and lower body aerobic workout.

It is also an object to provide a lightweight, portable physical therapy apparatus.

It is yet another object to provide a physical therapy apparatus which lends itself to being compact and can be easily stored.

According to the present invention, a physical therapy apparatus is adapted to be used with any suitable seating surface and which includes a light weight tubular frame, a seat portion, and a means for simultaneously working the upper and lower body. The seat includes a member adapted to readily interfit with the frame and includes a flange portion for frictionally engaging the seating surface. The means to work the upper and lower body is mounted on the frame and comprises foot pedals and hand grips movably interconnected by flexible motion transmitting members.

The above and other objects and advantages of this invention will become more readily apparent when the following description is read in conjunction with the accompanying drawings.

DETAILED DESCRIPTION OF THE PREFERRED EMBODIMENTS

Figure 1:
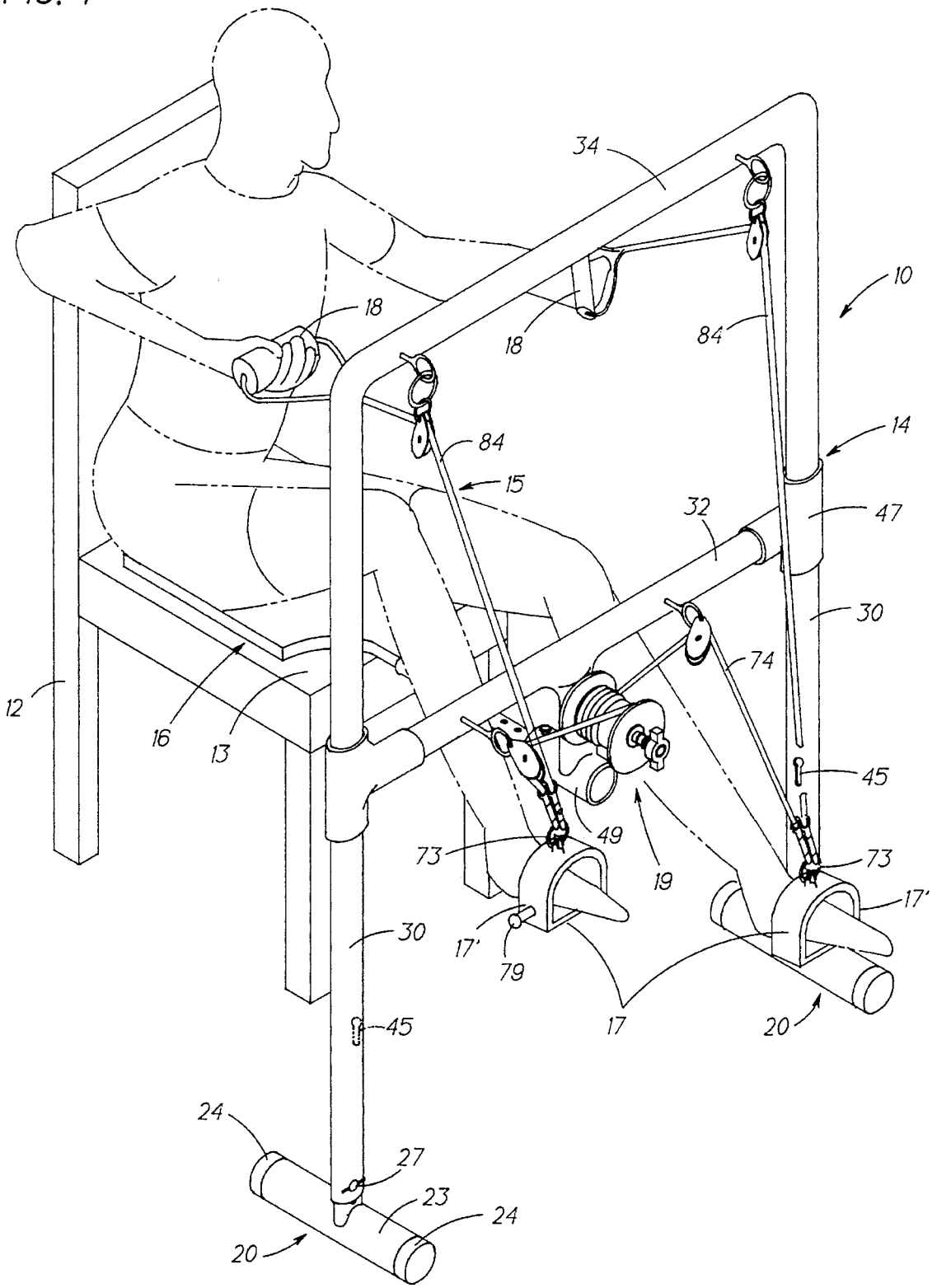
FIG. 1 is a perspective view of one embodiment of the physical therapy apparatus of this invention shown being used by a person being seated upon a conventional chair.

In FIG. 1, a physical therapy apparatus 10 of the type embodying this invention is shown being used for physical therapy of the aerobic type for simultaneous rehabilitation of both the upper and lower body from a seated position in a conventional chair 12. The apparatus comprises a frame 14 and a chair coupling member 16 to enable the user to simultaneously workout aerobically the lower and upper body using foot pedals 17 and hand grips 18 interconnected by the flexible means which transmits the dynamic tensioning between the feet and hands of the user, as shown generally at 15 in FIG. 2. A tension adjusting mechanism 19 is also provided to control the amount of force required for operating the foot pedals and the handgrips connected thereto, as will be hereinafter described.

Figure 3:
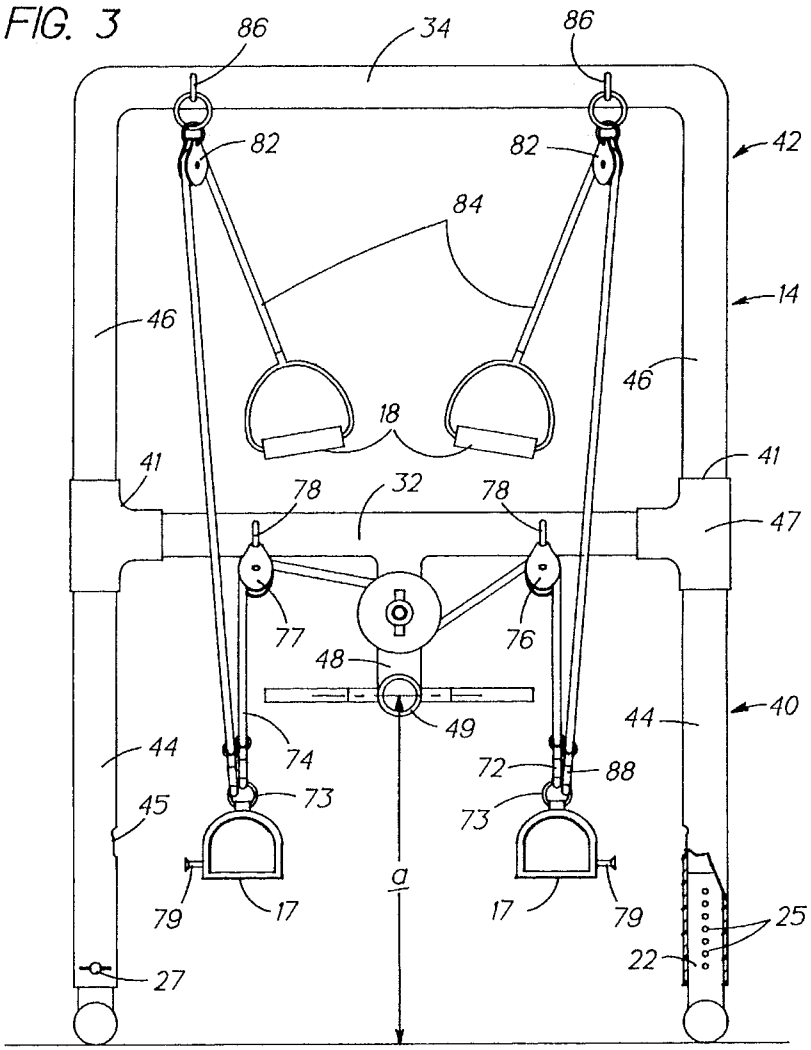
FIG. 3 is a front elevational view of the apparatus of FIG. 1.

The frame 14 comprises ground engaging horizontal members 20, upwardly extending stanchions 30 and laterally extending cross-members 32 and 34. The frame is preferably formed of a lightweight, tubular, inexpensive material, such as light weight steel, aluminum or a polymeric material which may be of the polyvinylchloride type. The ground engaging members 20, shown in FIGS. 1 and 2, serve to maintain the frame 14 in a stable upright position and enables the vertical adjustment of the frame to the desired or appropriate height for various chair heights. Referring to FIG. 3, a base support member 20 comprises a short length vertical tube in the form of a stub or stem portion 22 that extends upwardly from approximately the midpoint of each horizontal foot portion 23. Each stem 22 is adapted to interfit within the lower end of the tubular stanchions 30 and, as shown in FIG. 3, is provided with a plurality of vertically spaced holes 22 disposed along the length thereof. A pin 27 extends through an opening adjacent the lower end of each of the vertical stanchions 30 and into any of the holes 22 to secure the frame at any predetermined height in relation to the height a of the seat coupling member 16 and will be approximately the same as the height b of the seating surface 13 of the chair 12. A cap 24 formed of skid resistant material, such as rubber, may be placed over each end of the foot member 23 to assist in preventing the frame from sliding about when the apparatus is being used.

In the embodiment shown in FIG. 3, the frame 14 comprises a lower portion 40 and an upper portion 42, the upper portion being a unitary tubular member of generally inverse U-shape that includes a cross-bar 34 and depending leg portions 46. The lower section 40, as shown in FIG. 3, comprises tubular leg portions 44 that extend upwardly from base members 20 and cross-bar member 32 secured together by the T-shaped pipe couplings 47 at each end thereof. The upper member 42 can also be readily disassembled from the lower member 40 by simply applying an upward thrust on the cross-bar 34 to disconnect the lower ends of the leg portions 46 from the upper limb of the coupling 47 should the user find it necessary or desirable to employ only his or her lower body in a particular physical therapy regimen.

Figure 2:
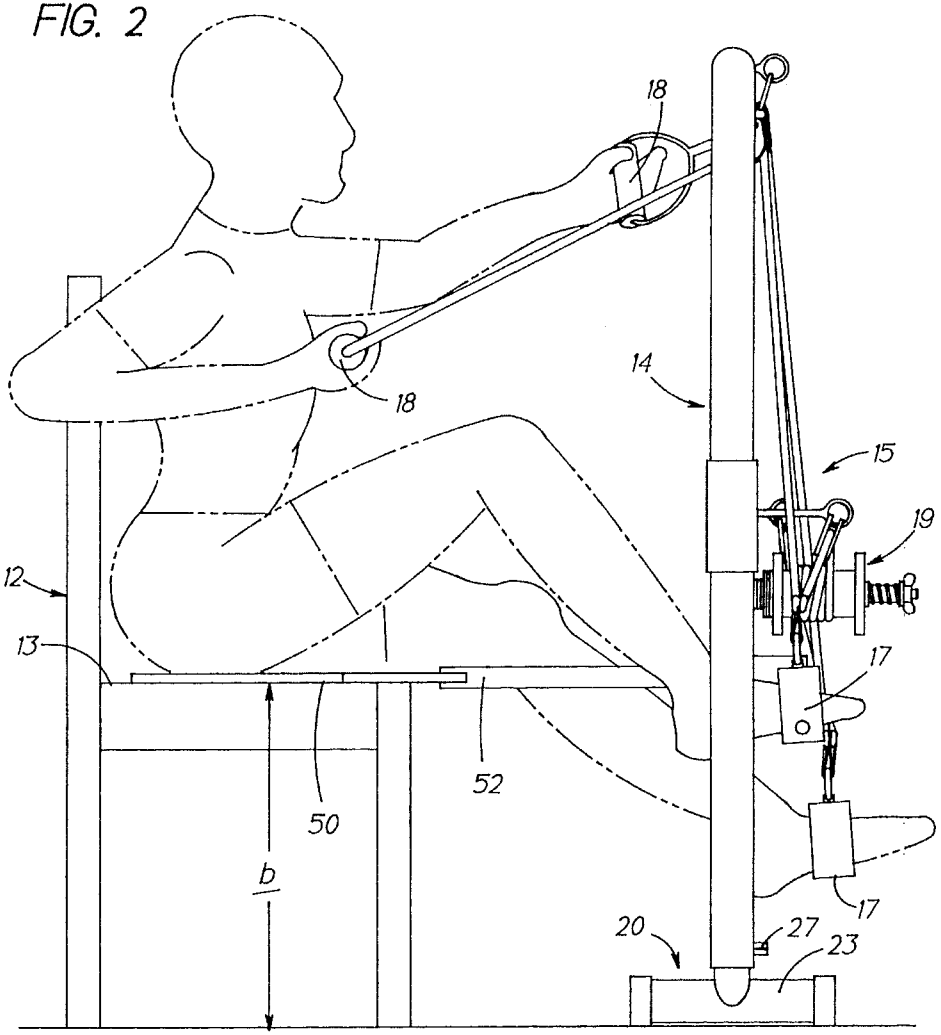
FIG. 2 is a side elevational view of the apparatus of FIG. 1 shown being used by a person being seated upon a conventional chair.

The upright tubular leg portions 44 and 46 are approximately one-half of the overall height of the frame which is vertically adjustable to accommodate users of various body sizes whereby one size device "fits all" potential users. Indeed, the frame 14, foot pedals 17 and handgrips 18 are ergonomically designed and located for easy access and use by virtually any person seated in a chair 12, as shown in FIGS. 1 and 2. The foot pedals 17 each comprise a generally flat and rigid lower portion and a substantially more flexible retainer or arcuately shaped portion 17' which serves to retain the toot in operative relationship with the pedal. Keyhole shaped slot 45 (FIG. 1 ) is disposed intermediate the ends of each of the lower tubular members 44, as shown in FIG. 3, to support the foot pedals 17 when not in use, as will hereinafter be described.

Figure 4:
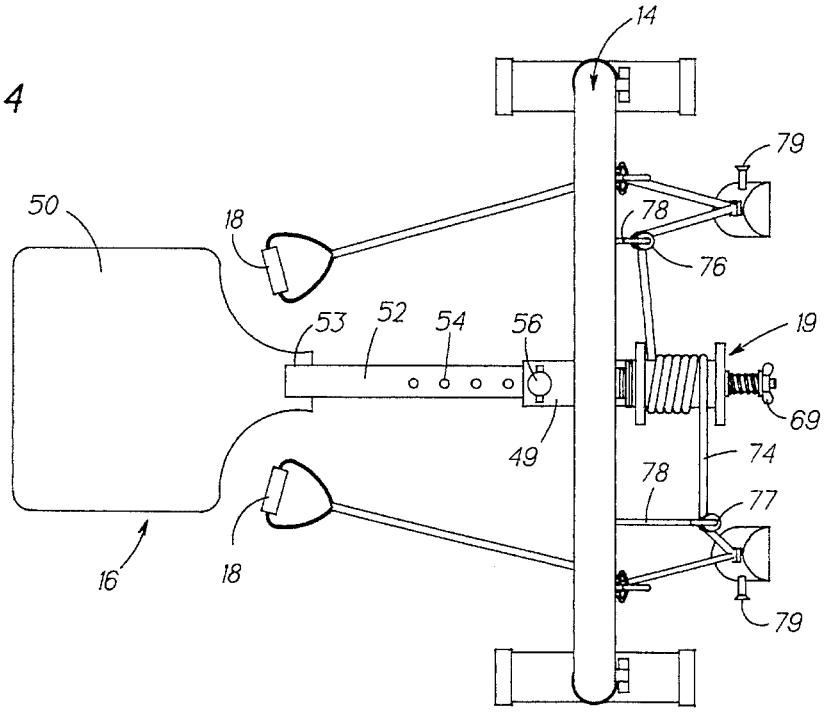
FIG. 4 is a top plan view of the apparatus of FIG. 2.

The seat, or chair coupling member 16, as best depicted in FIGS. 1, 2 and 4, comprises a saddle, or flange member 50 adapted to engage the upper seating surface 13 of any chair 12. The coupling member also includes an elongated rod 52 for reasons of comfort which, except for its end portion 53, may be flattened or otherwise configured to be connected to the forward edge of the saddle 50, preferably of cylindrical, tubular cross-section, is adapted to interfit within a tubular fitting or socket 49 on the frame 14. The socket 49 is disposed at a generally central location on the frame and more particularly is disposed at the lower end of a strut 48 (FIG. 3) that depends from approximately the center of the cross-bar 32. The tubular socket 49 extends horizontally from the lower end of the strut 48 and is perpendicular thereto. The socket 49 has an opening at the end thereof facing outwardly of the frame 14 so that it is positioned to receive the outer end portion on the rod 52 of the chair coupling member 16 (FIG. 4) in slide-fitting engagement. A cross-pin (not shown) may be provided if necessary to securely retain the rod 52 in the socket 49.

The saddle or panel 50 is constructed to have a degree of flexibility to conform ergonomically with the buttocks of persons using the apparatus and with the contours of the seat portions of the various types of chairs which may be used by such individuals. It is also important that the undersurface of the panel having a coefficient of friction so that the panel will not slip relative to the seating surface of the chair 12. In addition, the panel is preferably formed of a flexible material such that it will readily conform in shape or contour to various types of seating surfaces of conventional chairs, wheelchairs and the like to provide comfort to persons using the apparatus. The height of the saddle portion of the frame, as is the height of the frame, is such as to enable persons of various heights, leg and torso lengths who may be using the apparatus 10 to perform various aerobic activities, to be described hereinafter.

Figure 5:
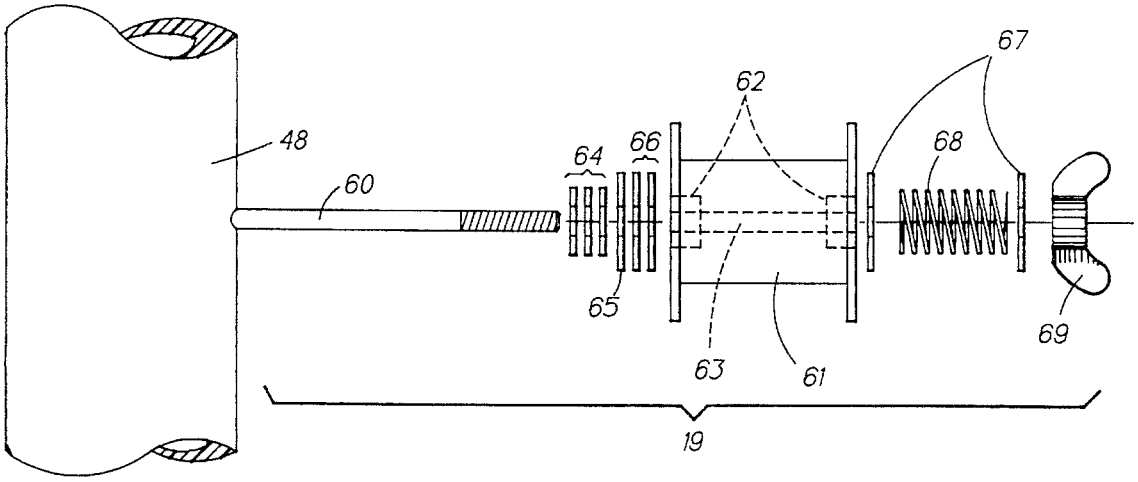
FIG. 5 is an exploded view, on an enlarged scale, of the drag adjusting means of the present invention of FIG. 4.

Referring to FIG. 5, the tension adjusting mechanism 19 comprises an axle 60, a spool or capstan 61, a plurality of washers 64, 65, 66 and 67, a coil spring 68 and a wing nut 69 rotatable to adjust the tension of the mechanism. One end of the axle is mounted to the depending member or strut 48 of the frame 14 (see FIG. 3) and the other end thereof is threaded. A plurality of washers 64, preferably rubber, are fitted onto the axle 60 and disposed against the dependent member 48 to act as a spacer and a buffer to protect the frame from wear. A washer 65, preferably metal, and a plurality of washers 66, preferably polyethylene, are then fitted onto the axle 60. The polyethylene washers have a low coefficient of friction so that the spool or capstan 61 can be smoothly rotated easily about the axle 60. The capstan 61, having a set of bearings 62 fitted within a bore 63 thereof, is fitted onto the axle followed by the coil spring 68 with two washers 67 disposed on both sides of the spring. The washers, spool and spring are retained on the axle by a wing nut 69 which is threaded onto the axle. The wing nut also adjusts the drag on the spool 61. As the wing nut is tightened, the spring 68 is compressed thereby increasing; the drag upon the capstan 61. Conversely, the drag on the capstan is decreased by loosening the wing nut to expand the spring.

The means to workout the user's lower body include two foot pedals 17 connected to each other by the flexible tensioning means 15 which, as shown, comprises a cable 74, such as wire or rope, each of which are secured by a coupling hook 72, such as a swivel-type snap-hook, to an eyelet or ring 73 affixed to the upper surface of each foot pedal 17, as shown in FIGS. 1 and. 3. The cable is movably supported by pulleys 76 and 77 mounted to the cross-bar 32, as by eye bolts 78. The cable 74 is threaded through pulley 76, looped a number of times around the spool or capstan 61 of the tension adjusting mechanism 19 through the pulley 77 and downwardly to the other foot pedal 17. As shown in FIG. 4, pulley 77 is mounted on the eyelet 78 which has a substantially longer support post than the other eyelet 78 so that it will extend outwardly from the cross-member 32 a substantial distance greater than the other eyelet so that the lead in and lead out portions of the cable from pulleys 76 and 77 will be generally parallel to each other, as best shown in FIG. 4, thus providing for a smooth nonbinding motion of the cable about the capstan. Each foot pedal 17 has a pin 79, shown in FIG. 3, projecting from the side thereof and having an enlarged head portion adapted to engage the keyhole slot 45 provided adjacent the lower ends of the stanchions 30. The pins 79 are fitted into the enlarged end of the keyhole slot 45 and moved downwardly toward the lower, narrow end thereof for supporting the foot pedals in fixed position thereby providing for easy insertion of the user's feet therein.

Means to enable the user to workout his or her upper body, shown in FIG. 3, comprise hand grips 18, pulleys 82 and flexible lines, cables or ropes 84. The pulleys 82 are mounted to the upper cross-member 34, preferably by eye bolts 86, spaced apart approximately equal to the shoulder width of the average user centered thereabout. The upper pulleys 82 are spaced apart a distance greater than the spacing of the lower pulleys 76 and 77 to prevent the cables 84 connected to the hand grips from entangling the lower pulleys and the cable 74 is connected to the foot pedals 17. To workout each arm, one cable 84 is threaded through the upper pulley 82 having one end connected to one of the hand grips 18 and the other end secured by a coupling hook or a swivel-snap hook 88, to the foot pedal 17 disposed directly below the upper pulley 82 on the eyelet ring 73.

Figure 6:
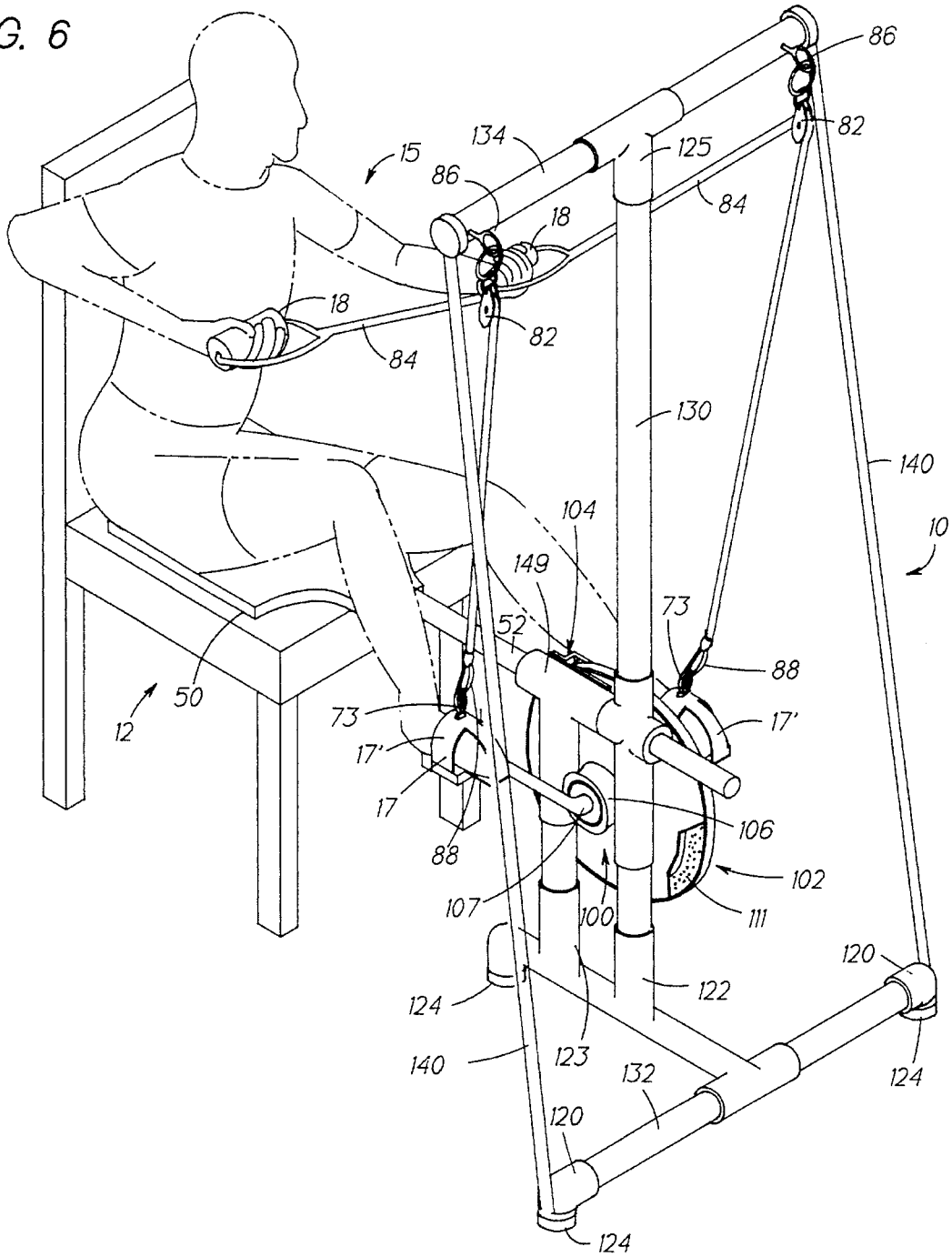
FIG. 6 is a perspective view showing an alternate embodiment of this invention.

An alternate embodiment of the invention, as depicted in FIG. 6, wherein the same reference characters are used to identify parts common to the two embodiments. The apparatus of this embodiment comprises a frame 10, a bicycle crank mechanism 100 having foot pedals 17 thereon drivingly connected to a rotatable disc or flywheel 102, an adjustable drag mechanism 104 and cables 84 for interconnecting each of the foot pedals 17 to one of the handgrips 18. The frame includes a lower, horizontal and laterally extending base member 132 disposed on laterally spaced ground engaging supports 120 disposed adjacent opposite ends of the base member 132 and in which are provided with a slip-resistant rubber or plastic discs 124. In addition, the base portion of the frame includes a horizontal tubular member 133 which extends in perpendicular relationship from approximately the center of the member 132 and terminates in a downwardly extending portion having on the lower end thereof a ground engaging pad 124. The lower end of a stanchion 3130 interfits with a tubular member 122 which extends upwardly from the tubular member 133 and terminates at its upper end in a T-shaped coupling member 125 which receives and supports an upper horizontal, transverse bar member 134. For additional stability, braces 140 may be provided to extend from the outer ends of base member 132 to the outer ends of the tubular member 134. Pulleys 82 are mounted on the frame adjacent the outer ends of the member 134, preferably by eye bolts 86 and each is adapted to receive therein one of the cables or flexible strands 84 connected at one end to each of the handgrips 18 and at the opposite end to each of the foot pedals 17. Intermediate the two horizontal members 133 and 134 is a tubular member 149 and extends generally perpendicular to a plane defined by stanchion 130 and cross-bar 134 of the frame 10. A second upright tubular shaft 123 extends from the base member 133 in generally spaced parallel relationship with the lower portion 122 of the stanchion 130 and provides additional support for the tube 149. The bicycle crank 100 is supported between the parallel tubular members 122 and 123 and the flywheel 102 is adapted to be rotated by the crank arms 107 on the outer ends of pedals 17 are disposed.

Figure 7:
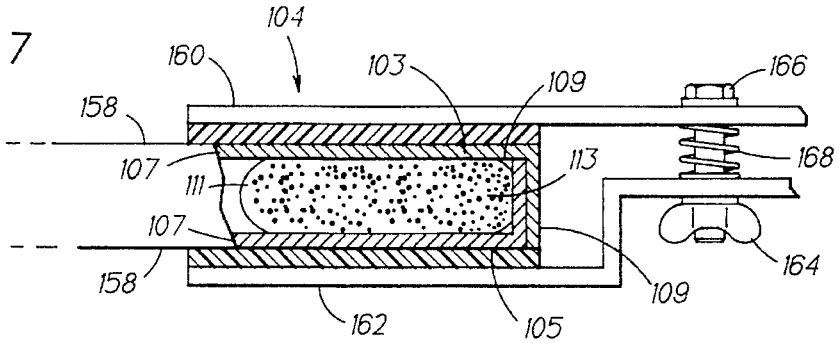
FIG. 7 is a sectional view taken through the drag mechanism used in the therapy apparatus of FIG. 6.

The crank mechanism 100 may be of a conventional bicycle type and includes a bearing or bushing 106 for rotatably supporting the horizontal shaft portion 107 between the two arms of the bicycle crank. The disk or flywheel 102 is fixed at its center opening to the shaft 107 and is rotatable with movement of the pedals whereby because of its moment of inertia (I=mr2), any fluctuations in the torque being applied by the action of the pedals 17 will be overcome or smoothed-out. Invariably, the more expensive and better quality exercise bicycles, such as those sold by Amerece Tunturi, a Swiss company are provided with flywheels on the order of 16 inches in diameter and having a solid steel rim portion with a radial dimension of approximately 2.5 inch and a thickness of about 1.25 inch. It will be recognized that to accomplish their intended purpose, such flywheels are necessarily relatively massive structures of substantial weight and large diameter and greatly increase the cost of the apparatus on which they are used. In accordance with this invention, the flywheel 102 preferably comprises a relatively inexpensive disc fabricated of aluminum or synthetic plastic material and as shown in FIG. 7 is of hollow construction. The flywheel 102 is constructed of two discs 103 and 105, each of which includes planar side wall 107 and a peripheral rim portion 109 which are dimensionally selected to fit snugly together to form the hollow disc or wheel. To increase the moment of inertia of the wheel, as shown, a flexible plastic bag 111 filled with sand 113 and having a length approximately equal to the perimeter of the inner surface of the wheel is disposed within the wheel 102. In addition, if necessary or desirable, the stability of the physical therapy apparatus embodying this invention may be increased by the addition of sand filled plastic bags disposed in the lower portions of the lightweight tubular frame 10, such as tubular members 132 and 133. This construction enables the physical therapy apparatus embodying this invention to emulate the operational characteristics of the upscale models of stationary exercise machines despite the fact that they are capable of being manufactured at much lower cost than such other devices.

Operation of the FIG. 6 embodiment is generally similar to that of the other embodiment, as one operates the foot pedals, the flywheel will rotate in response thereto. In addition, the handgrips 18 will be moved directly in response movement of the foot pedals 17 which include semi-circular loops 17' interconnected to the handgrips 18 by cables 84 which may be similar to those shown as in FIGS. 1–3. A ring 73 is disposed on the upper surface of each of the pedal loops for interconnecting with a snap-coupling member 88 on the lower end of each of the flexible cables 84. A pulley 82 disposed adjacent each of the outer ends of the upper cross-bar 134. The pulleys are adapted to receive therein the cables 84 for transmitting the movement of the pedals to handgrips 18 disposed on the opposite ends of each of the cables 84.

The intermediate tube 149 is adapted to assist in supporting the crank mechanism 100 but also serves to receive and retain therein, during use of the apparatus, the longitudinal rod portion 52 of the seat coupling member 16, as also shown in FIG. 4. The bearing portion of the crank mechanism is mounted between opposed portions of the two upright shafts 122 and 123. The drag mechanism 104 is mounted adjacent the flywheel 102, as shown in FIG. 7, and is secured on the outer sidewall portion of the tube 149. The mechanism is adjustable for varying the drag on the flywheel 102 of the bicycle crank mechanism. The mechanism includes a pair of brake pads 158, one being fixed to a stationary or fixed plate 160, the other being affixed to a plate 162, movable toward and away from the fixed plate for varying the frictional drag on the flywheel having a edge portion disposed between the two pads. A wing nut 164, or the like, as shown, threaded onto a bolt 166 that extends through the two plates and a coil spring 168 fitted onto the bolt between the two plates for urging the plates apart against the force applied by the nut when the latter is tightened. Upon turning the nut in a clockwise direction against the spring force, the two pads will be pressed together so as to increase the force and power required to rotate the flywheel in response to operating the pedals 17.

To operate the physical therapy apparatus, the seat coupling member 16 of the apparatus 10 is placed upon the seating surface 13 of the chair 12 and the user sits thereon. The weight of the user anchors the light weight frame 14 in fixed position wherever situated on the floor and in relation to the user's chair to stabilize the apparatus while being used without the necessity of any special fasteners or anchoring means. The position of the user's body may be varied, depending on the chair used, to an upright, reclined, or supine position. The user then places his feet within the foot pedals 17 and grasps the hand grips 18, as shown in FIGS. 1 and 2. The user has the option to use only the foot pedals by simply disconnecting the cables 84 of the hand grips 18 from the foot pedals 17 or removing the upper portion 42 of the frame 14 altogether.

To operate the apparatus 10, the user exerts an outwardly and downwardly directed force on one foot pedal 17 while, at the same time, pulling on the opposite hand grip 18 fastened to the other foot pedal. Upon completion of one stroke, the process is reversed and the user would then push on the other foot pedal outwardly while pulling inwardly on the other hand grip secured to the first foot pedal. The hand grips may also be used to provide added resistance to the foot movements by exerting an inward restraining force on the outward movement of the foot pedals. This action provides an isometric workout or dynamic tension of the arms and legs of the user. The action of the foot pedals causes the cable 74 to alternately rotate the spool 61 of the tension adjusting means 19 in opposite directions. The force required to operate the pedals is proportional to the drag applied to the spool 61 by the coil spring 68 which is adjustable by tightening or loosening the wing nut 69, as described hereinbefore. The tension adjusting means 19 and drag means 104 of FIG. 6 may be adjusted as desired and may be set to provide little or no resistance in addition to that applied by the user's legs and arms working against each other for an essentially isometric workout. Thereafter, as the individual's condition improves the apparatus may be easily adjusted to increase the workout achieved.

The use of cables to interconnect the foot pedals 17 and hand grips 18 permit various exercises and movements to be performed. The cables 84 that interconnect each pedal and corresponding hand grip do not have a fixed or limited path of motion which must be performed to operate the apparatus 10. A user may therefore perform varying aerobic and isometric movements with their arms or legs thereby allowing one who is elderly or convalescing from an injury or illness to operate the apparatus within his or her range of capability. This wide range of operating the foot pedals also permits different muscle groups to be worked. To vary the movements of the lower body in an up and down motion, a user may position the seat coupling member 16 so that the user's legs are fully extended. The user can then move the chair toward or away from the frame 14 until the knees are bent to a greater or lesser extent so that the user would be able to obtain a therapeutic workout of various leg muscle groups. The arm movements can also be varied to work different muscle groups. For example, the user may perform a pulling motion using the entire arm with the user's elbows either down by the side or raised to shoulder height to workout both the arms and chest. The user may also keep the elbows stationary and close to the body and perform a curling motion to only workout the arms.

The user may also cross the hand grips 18 so that the left hand is connected to the right foot and the left foot is connected to the right hand. In this configuration, the left arm and right leg move in unison as will the right arm and left leg which provides an arm and leg motion similar to walking. To prevent the two cables 84 from rubbing together during operation, the user can keep one arm slightly lower than the other. In the alternative, one of the upper pulleys 82 mounted on the upper cross-member 34 of the frame 14 may be mounted slightly lower than the other upper pulley 82.

In addition, an amputee or person who may have temporarily lost the use of either an arm or leg may, despite such a handicap, also benefit from the use of the physical therapy apparatus 10 embodying this invention. The user who has the use of only one arm, such as the right arm for example, may simply disconnect the cable 84 normally connected to the left hand grip 18, permitting the workout of the user's legs and the "good arm". In addition, a person who has use of only one leg may use the apparatus by connecting the lower ends of both cables 84 to the one foot pedal 17 that person is capable of using.

Although the invention has been shown and described with respect to an exemplary embodiment thereof, it should be understood by those skilled in the art that the foregoing and various other changes, omissions, and additions in the form and detail thereof may be made therein without departing from the spirit and scope of the invention.

Having thus described my invention, what is claimed is:

1. A physical therapy apparatus adapted to be used by persons seated on any conventional chair comprising a ground engaging frame, a seat coupling member comprising a flange portion for frictional engagement with the seating surface of said chair and an elongated extension for interengaging with said frame to retain said frame and chair in a predetermined spatial relationship for performing workout routines from a seated position on said chair, a pair of handgrips and a pair of foot pedals movably supported by said frame, each of said foot pedals connected to a rotatable member disposed between said foot pedals, and a pair of flexible motion transmitting cables, each of said cables being connected at one end thereof to one of said foot pedals and at the other end, to one of said handgrips for interconnecting each of said foot pedals to each of said handgrips, said frame including a second portion which extends to a level substantially higher than said foot pedals and said seat coupling member, and guide means disposed on the second portion of said frame which is adapted to receive said cables thereon to define a first free span of said cable from each foot pedal to said guide means and a second free span of each cable from said guide means to each handgrip whereby when said cables are in tension, as by applying a force to said handgrips while operating said pedals, the second free span of each of said cables may be operated at various oblique angles in relation to the first free span to enable aerobic exercises of the upper and lower body simultaneously by using said apparatus while in a seated position.

2. A physical therapy apparatus, as set forth in claim 1, wherein said rotatable member comprises a capstan and said foot pedals are connected to said capstan by a flexible cable having end portions connected to each of said pedals and a medial portion wound around said capstan to rotate the same in response to movement of the pedals.

3. Physical therapy apparatus, as set forth in claim 1, wherein said rotatable member comprises a flywheel and said foot pedals are drivingly connected thereto by a crank mechanism and a flywheel and wherein a drag mechanism is provided for engaging the surface of the flywheel for varying the energy expended in rotating the flywheel in response to operation of the foot pedals.

4. A physical therapy apparatus, as set forth in claim 2, wherein drag means is provided for adjusting the force required to rotate the capstan.

5. Physical therapy apparatus comprising a lightweight tubular frame, as set forth in claim 3, wherein said crank mechanism is supported on said frame along with a flywheel drivingly disposed on the crank mechanism and flexible motion transmitting means is provided for interconnecting each foot pedal to one of the handgrips.

6. A physical therapy apparatus adapted to be used by persons seated on any conventional chair comprising a ground engaging frame, handgrips and foot pedals movably supported by said frame, a seat coupling member comprising a flange portion for frictional engagement with the seating surface of said chair and an elongated extension for interengaging with said frame to retain said frame and chair in a predetermined spatial relationship for performing workout routines from a seated position on said chair and flexible motion transmitting means for interconnecting each of said foot pedals to one of said handgrips whereby upper and lower aerobic body workouts may be carried out simultaneously by the use of said apparatus from a seated position, said foot pedals being drivingly engaged with a crank mechanism and a flywheel and wherein a drag mechanism is provided for engaging the surface of the flywheel for varying the energy expended in rotating the flywheel in response to operating of the foot pedals, said flywheel being of hollow construction and including therein a granular material disposed about the periphery of the flywheel to increase the moment of inertia thereof.

7. A physical therapy apparatus, as set forth in claim 6, wherein a drag mechanism is disposed on said frame and includes pads for engaging the outer peripheral surface portion of the flywheel and in which the granular material is sand disposed in a flexible sheath disposed about the periphery of the flywheel.

8. A physical therapy apparatus, as set forth in claim 6, wherein the seat coupling member comprises a seat engaging portion having a rod extending therefrom adapted to engage said frame so that the body weight of the user will anchor the frame in fixed position and will assist in maintaining said chair and frame in predetermined spaced relation for using the apparatus.

9. A physical therapy apparatus, as set forth in claim 8, wherein said frame includes keyhole slots and each of the foot pedals includes a pin adapted to retain said pedals in fixed relation on the frame by fitting the pins into keyhole slots.

10. A physical therapy apparatus, as set forth in claim 9, wherein the frame further comprises an upper portion to support said hand grips and a lower portion to support said foot pedals and said seat coupling member, and said upper portion is detachable from said lower portion.

11. A physical therapy apparatus, as set forth in claim 10, wherein the frame has a means to adjust the height thereof.

12. A physical therapy apparatus, as set forth in claim 11, wherein the frame is formed of lightweight tubular material.

13. A physical therapy apparatus, as set forth in claim 12, wherein the lightweight material is polyvinyl chloride.

14. Physical therapy apparatus comprising a lightweight tubular frame, as set forth in claim 3, wherein said crank mechanism is supported on said frame along with a flywheel drivingly disposed on the crank mechanism and flexible motion transmitting means is provided for interconnecting each foot pedal to one of the hand grips.

* * * * *